United States Patent [19]

Nakanishi

[11] Patent Number: 4,953,861

[45] Date of Patent: Sep. 4, 1990

[54] BALL HITTING SPORTS TOOL

[75] Inventor: Motoyasu Nakanishi, Fujishi, Japan

[73] Assignee: Kabushiki Kaisha Sigel, Tokyo, Japan

[21] Appl. No.: 161,130

[22] Filed: Feb. 26, 1988

[30] Foreign Application Priority Data

Mar. 2, 1987 [JP] Japan ..... 62-30114
Mar. 30, 1987 [JP] Japan ..... 62-47049

[51] Int. Cl.[5] ..... A63B 59/00; A63B 53/00

[52] U.S. Cl. ..... 273/73 J; 273/75; 273/81 R; 273/DIG. 29; 273/81 D

[58] Field of Search ..... 273/81 R, 75, 73 J, 273/170, 26 B, DIG. 29, 81 D; 74/551.9, 557; 206/521, 584

[56] References Cited

U.S. PATENT DOCUMENTS

| | | | |
|---|---|---|---|
| 2,541,851 | 12/1949 | Wright | 273/DIG. 29 |
| 3,028,283 | 4/1962 | Lundgren et al. | 273/81 R |
| 3,575,764 | 4/1971 | McFarren | 428/156 |
| 3,616,158 | 10/1971 | Rubens | 206/584 |
| 3,762,707 | 10/1973 | Santorelli | 273/DIG. 29 |
| 3,770,033 | 11/1973 | Gavillet et al. | 273/81 R |
| 3,897,058 | 7/1975 | Koch | 273/26 B |
| 3,941,380 | 3/1976 | Lacoste | 273/72 A |
| 3,993,314 | 11/1976 | Harrington et al. | 273/170 |
| 3,995,856 | 12/1976 | Hollendorfer, Jr. | 273/81 R |
| 4,044,625 | 8/1977 | D'Haem et al. | 273/81 R |
| 4,105,205 | 8/1978 | Theodores | 273/73 J |
| 4,182,512 | 1/1980 | Kuebler | 273/73 R |
| 4,194,738 | 3/1980 | Inoue | 273/73 C |
| 4,347,280 | 8/1982 | Lau et al. | 273/81 R |
| 4,399,996 | 8/1983 | Boyce | 273/26 B |
| 4,429,068 | 1/1984 | Nakahira | 428/156 |
| 4,617,697 | 10/1986 | David | 273/81 R |
| 4,660,832 | 4/1987 | Shomo | 273/73 J |
| 4,696,842 | 9/1987 | Doubt | 273/75 |

FOREIGN PATENT DOCUMENTS

| | | | |
|---|---|---|---|
| 0225938 | 12/1959 | Australia | 273/170 |
| 0171033 | 2/1986 | European Pat. Off. | 273/73 C |
| WO87/05524 | 9/1987 | European Pat. Off. . | |
| 2106800 | 9/1971 | Fed. Rep. of Germany | 273/73 J |
| 3332643 A1 | 3/1985 | Fed. Rep. of Germany . | |
| 1398833 | 4/1965 | France | 273/73 D |
| 2273728 | 1/1976 | France | 206/521 |

*Primary Examiner*—Randall L. Green
*Assistant Examiner*—Gary Jackson
*Attorney, Agent, or Firm*—Wenderoth, Lind & Ponack

[57] ABSTRACT

A ball hitting sports tool has a ball hitting part and a grip part which is integrated with the ball hitting part through a stem and at least one of the ball hitting part, stem and grip part is provided with a buffer part in which a gel material with a penetration value of approximately 50 to 200 is used as a buffer material.

4 Claims, 4 Drawing Sheets

BALL HITTING SPORTS TOOL

BACKGROUND OF THE INVENTION

The present invention relates to a ball hitting sports tool such as, for example, a golf club, tennis racket and baseball bat.

Since this kind of sports tool has a ball hitting part and a gripping part which are continuously integrated and a thrown or hit ball or a stationary placed ball is powerfully hit by the ball hitting part, a large shock is conducted to a hand or hands of a player holding the grip part and a hand or arm of a player will occasionally be hurt or damaged. Particularly, if a ball is not properly hit at its center by the tool, a shock wave oscillates so as to be increased and is conducted to the player's hand, thus bring about a risk of injury or damage to his hand or arm.

Of this kind of the ball hitting sports tool, some types of tennis rackets and golf clubs have a grip part which is made hollow to reduce the weight. However, this type of the sports tool has a problem that a shock wave produced at the ball hitting part will continue for a long period of time as vibration. However, if the grip and the ball hitting part are made solid to solve the above problem, a problem will arise that the sports tool will be heavier and cannot be easily swung by a player.

SUMMARY OF THE INVENTION

An object of the present invention is to provide the ball hitting sports tool which is capable of reducing a shock produced at the ball hitting part when the ball is hit by the ball hitting part of the sports tool during the time while the shock is conducted from the ball hitting part to the grip.

To this end, the sports tool in accordance with the present invention has one of the ball hitting part, stem and grip following the stem provided with a buffer part to which a shock produced at the ball hitting part is conducted when a ball is hit by the ball hitting part and the buffer layer includes a gel material with a penetration value of approximately 50 to 200 such as, for example, silicone gel.

Another object of the present invention is to provide the ball hitting sports tool which has an external covering layer which is provided on the external surface of the grip to prevent slip and has a shock absorbing layer as a buffer layer.

For this purpose, the external covering layer having a number of gel material filled cells for preventing slip is formed at the external surface of the grip and these cells are filled with a gel material.

Another further object of the present invention is to provide the ball hitting sports tool in which the ball hitting part, stem and grip are partly or wholly made hollow with the buffer part inside the hollow part to damp the shock wave generated at the ball hitting part.

Therefore, the gel material is fitted inside the hollow parts of the sports tool so that it is lined along the internal wall of the hollow part or it is provided across the internal space of the hollow part.

In the ball hitting sports tool in accordance with the present invention, the shock generated at the ball hitting part is absorbed and damped by the buffer part before it is conducted to the player's hand or hands.

This buffer part employs the gel material with the penetration value of approximately 50 to 200 as a shock absorbing material and the energy of the shock is damped by deforming the gel material. Since the gel material has a characteristic which absorbs the external shock by nonelastic deformation when it receives the external shock and a characteristic that is similar to a propagation of shock in liquid, the repulsive elasticity is substantially negligible when the shock wave is absorbed and thus the shock wave is instantaneously conducted to the whole gel material and absorbed over a wide range.

Accordingly, in the sports tool of the present invention, the shock wave produced when the ball is hit is absorbed while its vibration is restrained and quickly absorbed by the whole buffer layer of gel material and accordingly the shock applied to the player is effectively damped.

DETAILED DESCRIPTION OF PREFERRED EMBODIMENT

Figure 1:
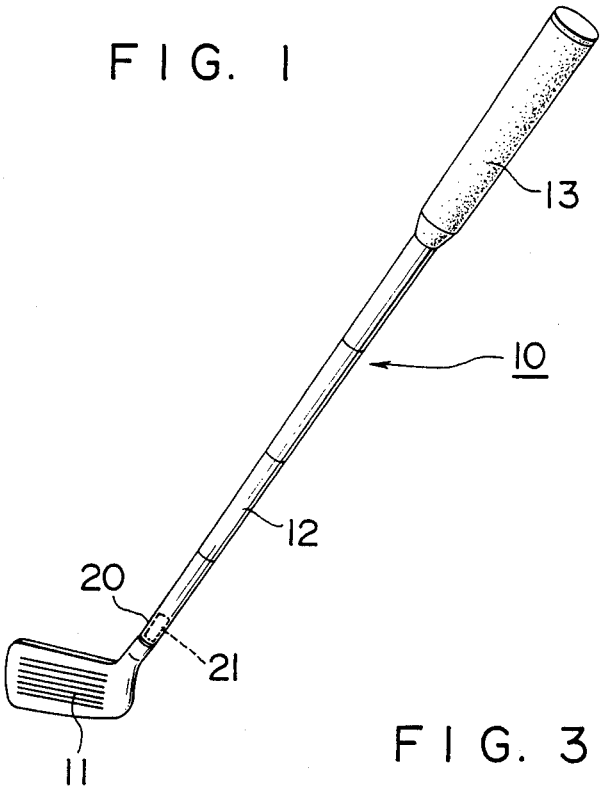
FIG. 1 is a front view of a golf club as one embodiment of the ball hitting sports tool in accordance with the present invention.

Referring to FIG. 1, there is shown a golf club 10 as one embodiment of the sports tool according to the present invention.

This golf club 10 comprises the club head 11 serving as the ball hitting part, the shaft 12 serving as the stem and the grip 13 serving as the gripping part, and the shock wave produced when a ball is hit is conducted to the grip 13 through the shaft 12.

In this embodiment, a buffer part 20 is provided inside the shaft 12 adjacent and just above the club head 11, said buffer part 20 being formed by fixing the buffer layer 21 made of the gel material with the penetration value of approximately 50 to 200 such as, for example, silicone gel in the shaft 12. Said buffer layer 21 can be formed by providing an empty space inside the shaft 12 and filling said empty space with silicone gel or by making a block by filling an elastic sheet with silicone gel and fixing this block in the shaft.

The penetration value shown above is a value measured according to JIS (Japanese Industrial Standard). K2530-1976 (50 g load) and closely related to the shock absorbing characteristic of gel material.

In other words, the gel material with the penetration value of less than 50 is hard and has poor shock wave propagation and, if the penetration value exceeds 200, the fluidity of gel material becomes so high that it reduces the shock absorbing effect due to the physical deformation of the gel material.

In case of the golf club 10 shown in this embodiment, the shock wave produced when the ball is hit is absorbed by the buffer layer 21 made of the gel material of the buffer part 20 through deformation of the buffer layer 21 and therefore the shock to be conducted from the grip 13 to the player's hands is substantially damped.

Figure 3:
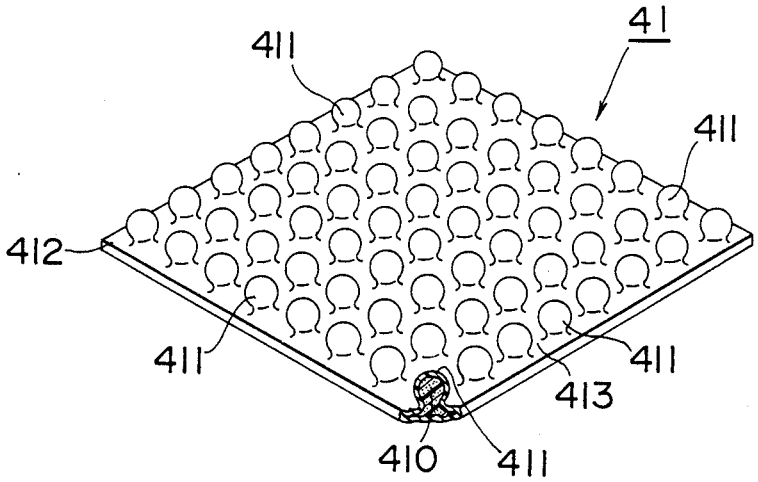
FIG. 3 is an enlarged perspective view, partly in section, showing a part of the gel material filled sheet employed in the external covering layer shown in FIG. 2.
Figure 2:
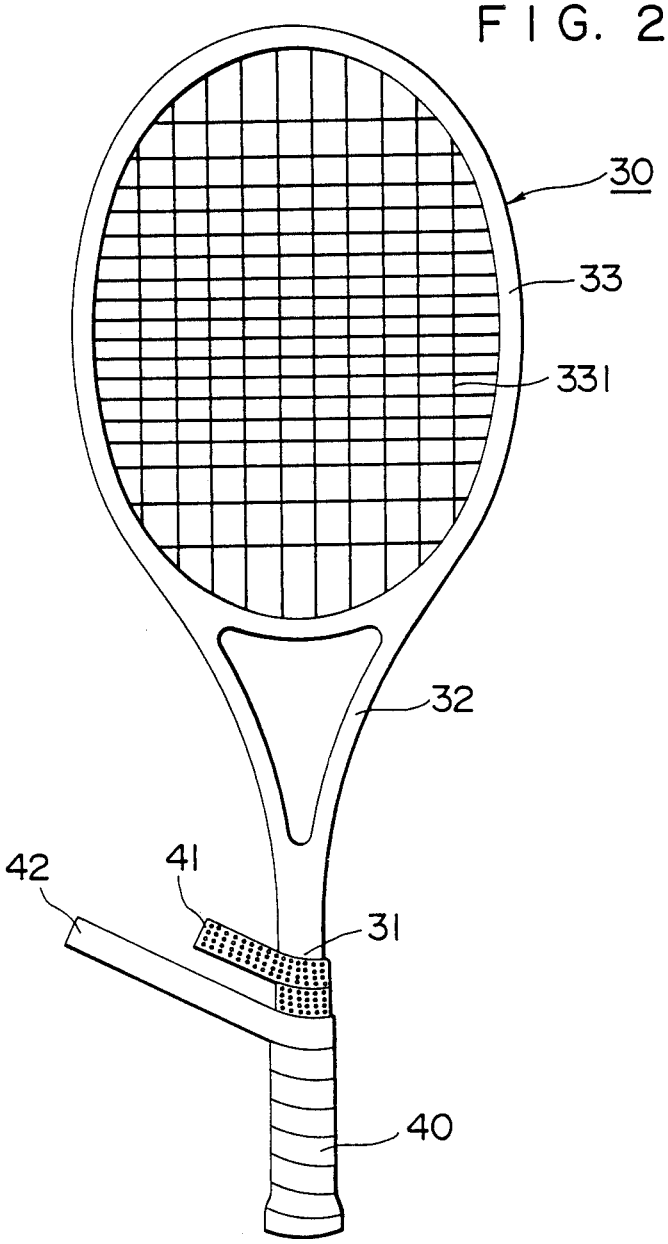
FIG. 2 is a front view of a tennis racket shown as another embodiment of the ball hitting sports tool in accordance with the present invention, showing partly unwound the external covering layer of the grip.

Referring to FIGS. 2 and 3, there is shown a tennis racket 30 provided with a buffer part 40 or the gripping part 31.

This tennis racket 30 has the forked stem part 32 to which the grip 31 is connected and the ball hitting part 33 which annularly extends from said stem 32 and a net 331 is stretched and fastened to the ball hitting part 33 to form the ball hitting surface.

Said grip 31 is provided with the buffer part 40 as the external covering layer and said buffer part 40 comprises a gel material filled sheet 41 wound as a shock absorbing layer around the grip 31 and a soft external covering sheet 42 such as, for example, leather or cloth wound around said sheet 41.

Said grip 31 is profiled by adhering a hard foamed synthetic resin, depending on the case. In case of this embodiment, the gel material filled sheet 41 is made in the shape of tape for application by winding applications.

The gel material filled sheet 41, as shown in FIG. 3 is provided with a number of gel material filled cells 411 which protrude from the surface of said sheet 41 and said cells 411 are filled with gel material 410.

Silicone gel is best suited as gel material for its stability; particularly, a silicone gel with the penetration value of approximately 50 to 200 measured in accordance with JIS K2530-1976-(50 g load) or a compound type silicone gel having fine hollow particles mixed therein excel in shock and vibration resistance.

Such compound type silicone gel is disclosed in the U.S. Patent Application Ser. No. 87,970 which was filed on Aug. 17, 1987.

FIG. 3 is a partly cutaway perspective view showing an embodiment of the gel material filled sheet 41, which comprises a sheet-like base 412 and a number of gel material filled cells 411 arranged on said sheet-like base 412. Gel material filled cells 411 are separated by linear grooves 413 so that said cells 411 are independent one from another and the cells are filled with gel material 410 so that the surfaces of said gel material filled cells 411 are bulged.

All gel material filled cells 411 are orderly arranged in high concentration and a small quantity of gel material is filled in each gel material filled cell in the state that the gel material is folded.

Such gel material filled sheet 41 is disclosed in the U.S. Patent Application Ser. No. 73067 filed on July 13, 1987 and the U.S. Patent Application Ser. No. 105562 filed on Oct. 8, 1987.

Said gel material filled sheet 41 has, a thickness equal to the height of gel material filled cells 411 and accordingly it exhibits a shock and vibration absorbing performance equivalent to a single thick plate type gel material layer. If the ball hitting sports tool around the grip 31 of which said gel material filled sheet 41 is wound, for example, the tennis racket of the embodiment, is used, the gel material filled sheet 41 exhibits a shock and vibration absorbing performance between the grip 31 and the player's palm to dispersedly absorb the shock and reduce the load on the player's wrist and elbow when he hits the ball. In addition, the oscillation of the shock is damped to restrain conduction to the palm. Spaces formed among gel material filled cells 411 substantially allow bending, crushing and deformation of the cells themselves. Accordingly, the gel material filled sheet 41 satisfactorily fits the unevenness of the player's palm when he holds the grip 31 to make holding easy and provides appropriate free deformation to release the twist of the wrist when hitting the ball.

In the above embodiment, the external covering sheet 42 is wound around the gel material filled sheet 41 to appropriately adjust the extent of deformation and flexibility of these cells 411 to avoid excessive deformation.

As described above, the ball hitting sports tool of this embodiment is adapted so that the gel material filled sheet 41 is wound around the grip 31, said sheet 41 has a number of gel material filled cells 411 which are arranged in high concentration, said gel material filled cells 411 are separated by linear grooves 413 so as to be independent one from another and filled with gel material 410 so that the flexible surfaces of said gel material filled cells 411 are bulged by said gel material 410 and such gel material filled cells 411 serve as the buffer layer to dispersedly absorb the shock when the ball is hit by this sports tool. Gel material is fixed at a specified position in each gel material filled cell to allow an appropriate holding force and free deformation at the grip 31, thus ensuring comfort in holding the tool and hitting the ball.

Figure 4:
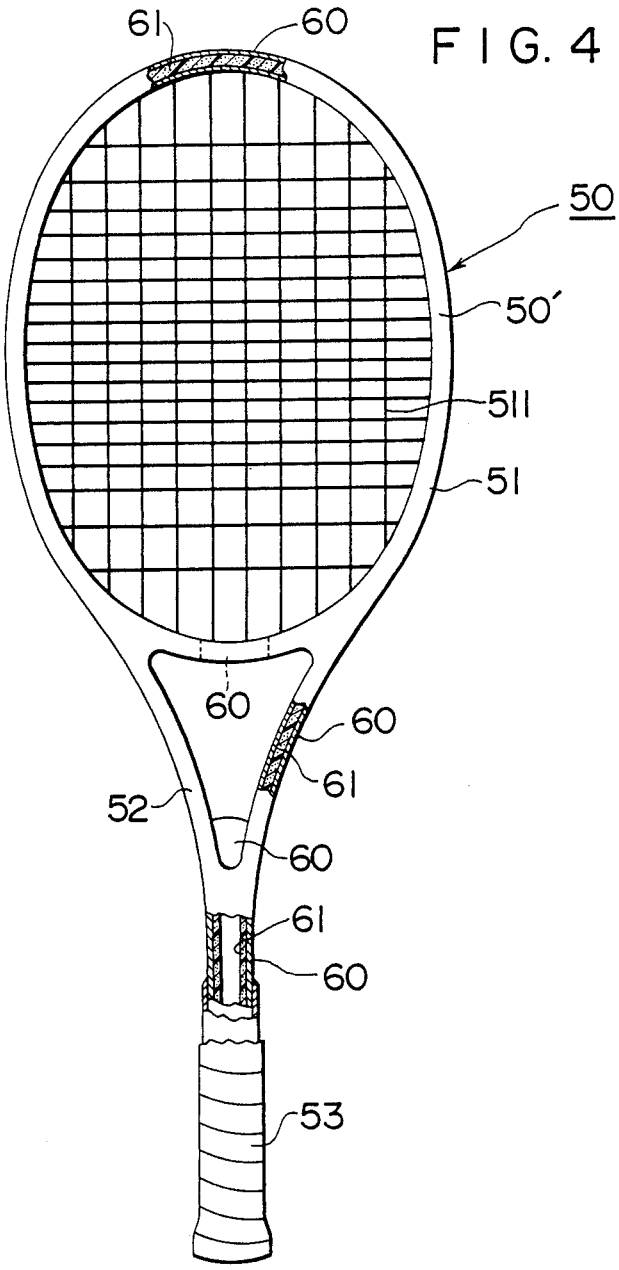
FIG. 4 is a partly cutaway front view of a tennis racket shown as another further embodiment of the ball hitting sports tool in accordance with the present invention.

Referring to FIG. 4, there is shown a tennis racket 50 having a hollow frame 50' as an embodiment of the present invention.

Though it is easy to use this type of tennis racket 50 having the hollow frame, there is still in it a problem that the shock wave produced when the ball is hit remains as vibration for a certain long moment.

In this embodiment, a buffer part 60 is provided in at least a part of the annular frame 51 which forms the ball hitting part of the tennis racket 50, the stem 52 attached to said frame 51 and the grip 53 attached to said stem 52.

A net 511 which serves as the ball hitting surface is formed in said frame 51 and the external covering layer 531 is formed on said grip 53. This external covering layer 531 can have the construction of the embodiment shown in FIG. 2.

Said buffer part 60 is provided with the buffer layer 61 made of gel material 611 with a penetration value of approximately 50 to 200.

Said silicone gel is suitable as the gel material. In this embodiment, the buffer layer 61 is formed by filling the hollow frame 51 with silicone gel or lining silicone gel along the inside surface of the hollow grip stock 53.

Moreover, the compound type silicone gel described hereinbefore is suitable as said silicone gel and, in the embodiment, a number of fine hollow particles 612 are mixed in the gel material 611.

The buffer layer 61 of said buffer part 60 can be formed by partly filling the top and/or lower parts of the frame 51 and/or the stem 52 and the grip 53 with gel material or wholly filling the frame 51, stem 52 and grip 53 with gel material. If these parts are formed as described above, the gel material increases the weight of the tennis racket and is expensive and therefore, for providing a larger buffer layer 61, it is desirable to make the buffer layer 61 by dually overlapping the gel material on the internal wall of the frame 50' as in the grip 53 shown in FIG. 4.

Furthermore, said buffer layer 61 need not be provided inside the hollow skeleton and can be provided at the forked portion of the stem 52 as shown in FIG. 4.

Figure 6:
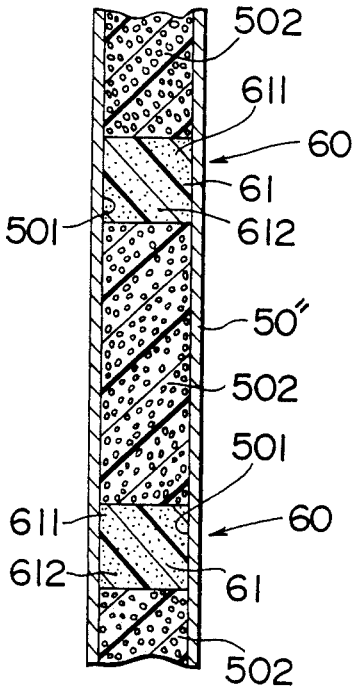
FIG. 6 is a vertical cross sectional view of a principal part showing another further embodiment of the present invention.

Said buffer part 60 can be provided by forming the hollow space 501 inside the solid frame 50'' as shown in FIG. 6 and arranging the buffer layer 61 is said hollow space. In this case, a favorable result in obtained from a type of tennis racket in which a foamed synthetic resin is used as the core member 502 of the skeleton.

Figure 5:
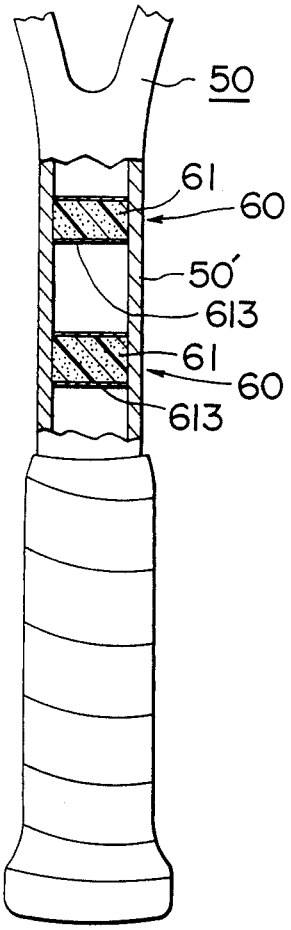
FIG. 5 is a partly cutaway front view of a principal part showing another further embodiment of the ball hitting sports tool of the present invention.

The buffer part 60 of the ball hitting part, stem and grip employing said hollow skeleton or solid skeleton can be constructed to have at least one buffer layer 61 which is extended in the transverse direction to the axis of the space inside the skeleton as shown in FIG. 5.

Hereupon, the buffer layer 61 can be provided using the gel material 611 covered with the covering layer 613 as shown in FIG. 5. Thus the silicone gel which has a strong adhesiveness or a tacking property can be easily handled.

In the above description, absorption of a shock by nonelastic deformation of the gel material does not mean that the gel material is not elastically deformed at all, but means that the gel material does not show such large elastic deformation as rubber and a spring, and that the gel material does not have the repulsive elasticity means that the repulsive elasticity of gel material is very much smaller than other elastic materials such as rubber and a spring. Accordingly, it should not be understood that the repulsive elasticity of gel material is zero.

The above embodiment is described in terms of a tennis racket but the present invention can apply to other various ball hitting sports tools such as, for example, baseball bats, golf clubs, etc.

The present invention is not limited to the embodiments and can be modified or changed within the range where the present invention does not deviate from the spirit of the claims.

What is claimed is:

1. A ball hitting sports tool comprising a ball hitting part for hitting a ball, a stem attached to said ball hitting part, and a grip attached to said stem and held by a player, said grip having a buffer part, said buffer part having at least one buffer layer which is positioned so that a shock from said ball hitting part is conducted to the position where said buffer part is located, said buffer layer being a gel material filled sheet filled with a gel material with a penetration value of approximately 50 to 200 according to Japanese Industrial Standard K2530 and having substantially non-elastic deformation and substantially no repulsive elasticity in response to a shock wave.

2. A ball hitting sports tool in accordance with claim 1, further comprising a soft flexible sheet wound around said gel material filled sheet.

3. A ball hitting sports tool in accordance with claim 1, said gel material filled sheet has a number of gel material filled cells which protruding from the surface of said sheet and a gel material is sealed in said gel material filled cells.

4. A ball hitting sports tool in accordance with claim 1, said gel material is silicone gel.

* * * * *